US005656192A

United States Patent [19]

Lee

[11] Patent Number: 5,656,192

[45] Date of Patent: Aug. 12, 1997

[54] IMMERSED METALLURGICAL POURING NOZZLES

[75] Inventor: Steven John Lee, Cardross, Scotland

[73] Assignee: Didier-Werke AG, Wiesbaden, Germany

[21] Appl. No.: 626,960

[22] Filed: Apr. 3, 1996

[30] Foreign Application Priority Data

Apr. 10, 1995 [GB] United Kingdom ..... 9507444

[51] Int. Cl.[6] ..... B22D 41/50

[52] U.S. Cl. ..... 222/606; 222/591; 222/607

[58] Field of Search ..... 222/606, 607, 222/590, 591

[56] References Cited

U.S. PATENT DOCUMENTS 2,063,377 12/1936 Helmer ..... 222/591
5,370,370 12/1994 Benson ..... 222/607

FOREIGN PATENT DOCUMENTS 0158561 7/1987 Japan ..... 222/606
2 056 430 3/1981 United Kingdom .

OTHER PUBLICATIONS

Patent Abstracts of Japan, vol. 95, No. 002 & JP–A–07 051818 (Kurosaki Refract Co Ltd), 28 Feb. 1995 * abstract *.

*Primary Examiner*—Scott Kastler
*Attorney, Agent, or Firm*—Wenderoth, Lind & Ponack

[57] ABSTRACT

An immersed metallurgical pouring nozzle, such as a submerged entry nozzle for pouring molten steel, comprises a body of refractory material, such as graphite alumina, which defines a flow passage. An annular member of refractory material, such as zirconia with a very low or no-content of carbon, whose erosion resistance is higher than that of the body of the nozzle is wholly encapsulated in the material of the body of the nozzle.

4 Claims, 2 Drawing Sheets

IMMERSED METALLURGICAL POURING NOZZLES

1. FIELD OF THE INVENTION

The present invention relates to immersed metallurgical pouring nozzles, that is to say pouring nozzles of which a portion, typically the downstream end, is immersed in a pool of molten metal, in use. The invention is particularly concerned with so-called submerged entry nozzles (SENs) for pouring molten steel, that is to say pouring nozzles which conduct molten steel from a tundish or other metallurgical vessel into a mould, typically a continuous casting mould from which the solidified metal is continuously withdrawn. The invention does, however, relate to other types of pouring nozzles, such as so-called ladle shrouds for conducting molten steel from a metallurgical vessel into a tundish, whose downstream end is also submerged, in use, in molten metal.

2. DESCRIPTION OF THE PRIOR ART

When continuously casting steel, molten steel is continuously introduced into the open upper end of the mould through an SEN whose lower end is submerged in the metal in the mould. The surface of the steel in the mould is thus exposed to the air and is thus subject to reoxidation. In order to prevent this and to minimise the heat loss from the exposed surface, the surface of the molten steel is typically covered by a layer of insulating powder comprising a combination of fluxing agents or glasses together with carbon, silica and alumina. The powder melts into a glassy layer which shields and insulates the molten steel surface and tends to be drawn down between the molten steel and the sides of the water-cooled mould and thus to act as a lubricant. However, this molten glassy layer has a highly aggressive and corrosive tendency with respect to the material of the SEN. The outer surface of the SEN tends to be rapidly eroded away by the glassy layer at the slag line, that is to say at the region at which the SEN passes through the surface of the molten steel and glass, and it is this erosion which limits the service life of the SEN and necessitates its being replaced relatively frequently.

SENs for casting steel are typically made of a mixture of alumina and graphite. The graphite is added to impart thermal shock resistance to the alumina because it will be appreciated that at the commencement of operation, even if the SEN is preheated, as is common, a relatively cold SEN is contacted by molten steel at a temperature of ca. 1550° C. which represents a very substantial thermal shock. Pure alumina would tend to crack when subjected to this thermal shock but graphite has a high coefficient of thermal conductivity and thus tends to accelerate the dissipation of thermal gradients and also has considerable lubricant characteristics and thus permits slight relative movement of the constituent alumina particles of an SEN without cracking occurring.

However, the presence of the graphite in the alumina reduces the resistance to erosion by the glassy layer at the slag line by its influence on the bonding matrix. Accordingly the graphite content need be as high as possible to produce one of the necessary characteristics of SENs, namely thermal shock resistance, and as low as possible to achieve the other necessary characteristic, namely resistance to erosion at the slag line. The construction and composition of all SENs thus necessarily constitutes a compromise between these two conflicting requirements.

Various different constructions of SEN have been proposed and used in an attempt to minimise these problems and certain of these are illustrated schematically in FIGS. 1*a*–1*d*.

FIG. 1*a* shows a simple SEN which is of uniform alumina graphite construction with its lower end immersed in a pool of molten steel 2 on which a glassy protective layer 4 of molten mould powder floats. As may be seen, the body 6 of the SEN is eroded very substantially at the slag line and the rate of wear or erosion is typically 7 to 10 mm per hour. The composition of such nozzles includes 40 to 65%, typically 51%, by weight $Al_2O_3$ and 20 to 35%, typically 31%, by weight C and has a bulk density of 2.20 to 2.65, typically 2.40 g/ml.

The modified SEN shown in FIG. 1*b* includes an annular body 8 of zirconia graphite which is copressed with the alumina graphite and affords the external surface of the SEN in the region of the slag line. The alumina graphite has the same composition as that set forth above and the zirconia graphite has a composition including 65 to 82%, typically 74%, by weight $ZrO_2$ and 17 to 25%, typically 20%, by weight C and a bulk density of 3.20 to 3.60, typically 3.60, g/ml. In this construction, the rate of erosion can be reduced to typically 1.5 to 3.5 mm per hour and whilst this represents a substantial improvement the rate of erosion is still substantial. The reason for this is that the zirconia graphite insert necessarily includes a significant graphite content in order that it has the necessary thermal shock resistance and this graphite content renders the bonding matrix of the insert subject to substantial rates of erosion at the slag line.

The further modified construction shown in FIG. 1*c* is very similar but in this case the entire lower portion of the SEN is made of zirconia graphite whose composition is the same as that set forth above. The performance and disadvantages of this construction are the same as those of the construction of FIG. 1*b*.

FIG. 1*d* represents a different approach in which a preformed, high temperature fired annular sleeve of sintered zirconia is secured by refractory cement to the external surface, in the region of the slag line, of an SEN of otherwise conventional shape. The zirconia sleeve has a very high erosion resistance, whereby the erosion is reduced to typically 0.2 to 0.5 mm per hour, but due to the absence of graphite its thermal shock resistance is lower which means that in practice this construction is unacceptable due to the possibility of thermal shock failure of the sleeve and/or its refractory cement connection to the SEN, especially if the preheating conditions are not accurately controlled.

Accordingly it is an object of the present invention to provide an immersed metallurgical pouring nozzle, particularly an SEN for pouring steel, which avoids the problems referred to above and which in particular has a reduced tendency to erosion at the slag line but which nevertheless is not subject to thermal shock failure.

SUMMARY OF THE INVENTION

According to the present invention an immersed metallurgical pouring nozzle, particularly an SEN, of the type comprising a body of refractory material which defines a flow passage and an annular member of refractory material whose erosion resistance is higher than that of the body of the nozzle is characterised in that the annular member is wholly encapsulated in the material of the body of the nozzle.

The body of the nozzle may be made of a single refractory material e.g. alumina graphite.

In a modified embodiment, the body of the nozzle comprises an upper portion of refractory material and a lower portion of refractory material in which the annular member is encapsulated and whose erosion resistance is greater than that of the upper portion but less than that of the annular member.

In a further modified embodiment the annular portion of the body of the nozzle which is situated outside the annular member is made of a refractory material whose erosion resistance is greater than that of the remainder of the body of the nozzle but is less than that of the annular member.

Thus the nozzle in accordance with the invention is provided with a band or annular member of erosion resistant material, as in the known constructions, but differs from the known constructions in that the erosion resistant material does not constitute a part of the outer surface of the nozzle but is surrounded by a layer of the material constituting the body of the nozzle.

In the known nozzles, at the beginning of pouring, the molten metal and erosive glass layer come directly into contact with the erosion resistant material which is thus subjected to a substantial temperature gradient and thermal shock and must be constructed to resist this. However, in the nozzle in accordance with the present invention, the molten metal and erosive glass layer do not initially come into direct contact with the erosion resistant material but instead contact the material of the body of the nozzle inside and outside it which means that the temperature gradient and thus the thermal shock to the erosion resistant material is subjected are substantially reduced. This means that the erosion resistant material need no longer represent the same compromise between thermal shock resistance and erosion resistance, or at least not to the same extent as previously, and thus that it may have a lower graphite content, preferably 0 to 10% and more preferably 6% or less, than was previously possible whilst still having adequate resistance to the reduced thermal shock to which it is subjected. Its erosion resistance may thus be substantially higher than was previously possible. The covering layer of the material of the body of the nozzle is rapidly eroded at the slag line but by the time the molten glass layer contacts the erosion resistant material it has already substantially reached the temperature of the molten metal and is not then subjected to a further substantial thermal shock.

Further features of the invention will be apparent from the following description of two specific embodiments of the invention which is given with reference to FIG. 2 of the accompanying drawings.

DESCRIPTION OF THE PREFERRED EMBODIMENTS

Figures 1A, 1B, 1C, 1D:
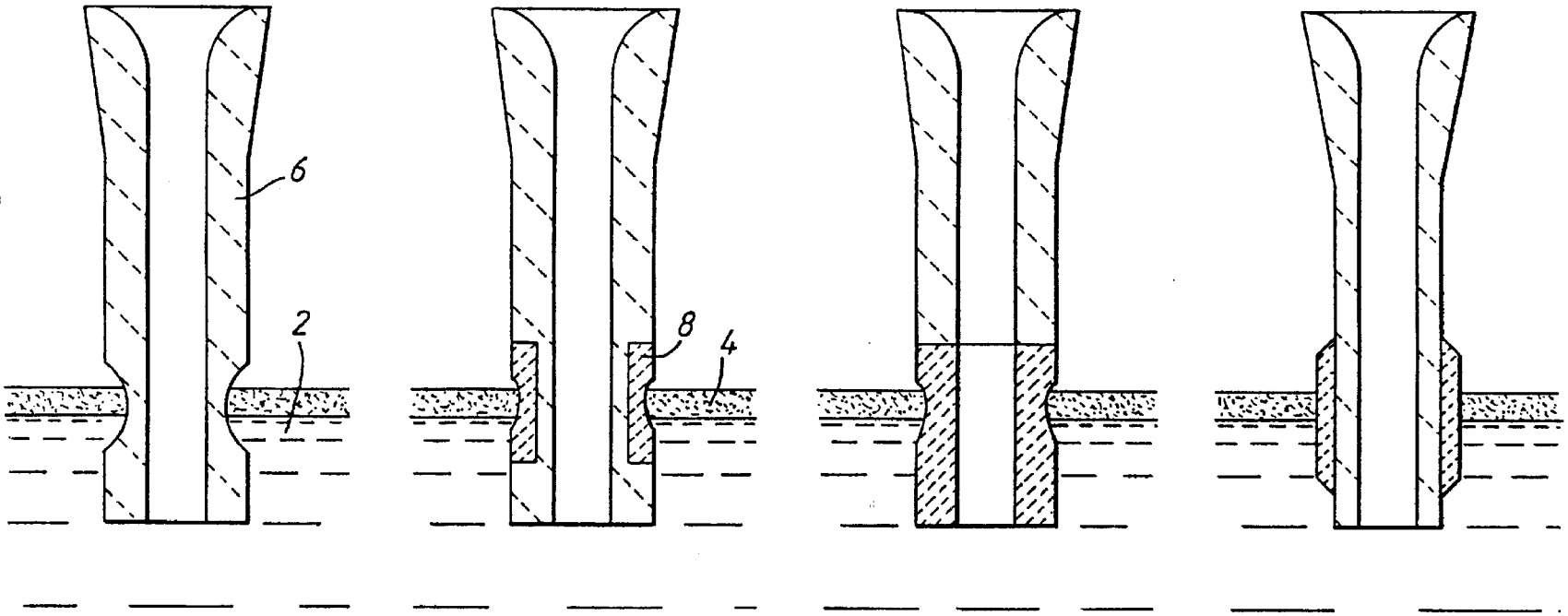
Fig.1a PRIOR ART
Fig.1b PRIOR ART
Fig.1c PRIOR ART
Fig.1d PRIOR ART
FIGS. 1*a*, 1*b*, 1*c* and 1*d* are diagrammatic axial sectional views of three known types of SEN.

The SEN shown in FIG. 2 comprises a tubular body 6 which defines a central flow passage 7 and is for the most part made of pressed alumina graphite, whose composition is the same as that described in connection with FIGS. 1*a*–1*d*. Wholly encapsulated within the body at its lower end, that is to say in the vicinity of the slag line, i.e. where the nozzle will pass through the layer of molten mould powder when it is in use, is an annular member 8 of substantially higher erosion resistance, e.g. carbon bonded zirconia, optionally with a low content of graphite. The annular portion 11 of the body 6 outside the insert 8 comprises a layer of zirconia graphite and this will be subject to the same compromise as regards carbon content as was discussed in connection with FIGS. 1*a*–1*d* and will therefore have the same composition as described in connection with FIG. 1*c*.

At the commencement of the operation, the annular member 8 is not directly contacted by molten steel or mould powder but is initially protected and insulated by the surrounding alumina graphite material of the annular portion 11. It is therefore subjected to a substantially reduced thermal shock which it can adequately resist with only a low graphite content. The outer layer of alumina graphite is rapidly eroded at the slag line, at a rate which is slower than that at which the alumina graphite of the remainder of the body would be eroded until the slag contacts the insert 8, whereafter the rate of erosion is further reduced, typically to less than 1 mm per hour.

The erosion resistant insert 8 may be a unitary, self-supporting member which is copressed with the alumina graphite of the nozzle body. It is preferred that the insert comprises carbon bonded zirconia comprising 85 to 92%, typically 88%, by weight $ZrO_2$ and 2 to 10%, typically 6%, by weight C and has a bulk density of 3.9 to 4.4, typically 4.1, g/ml. Alternatively, the insert may be presintered and incorporated into the nozzle body during its manufacture. In this event the insert will preferably contain 87 to 97%, typically 95.5%, by weight $ZrO_2$ and will have a bulk density of 4.1 to 4.6, typically 4.3, g/ml. However, the fact that the insert is not exposed to the atmosphere and is wholly supported by the material of the nozzle, opens up the possibility of the insert 8 being carbon and graphite free and in powder or partially presintered form in the as supplied state and then subsequently densifying and fully sintering under the action of the heat of the molten metal as the nozzle is first used. In this event the insert may comprise 84 to 94%, typically 92%, by weight $ZrO_2$ and will have a bulk density of 3.9 to 4.3, typically 4.0 g/ml. The material thus initially has a high thermal shock resistance which changes progressively to a high erosion resistance as sintering proceeds. If densification and sintering of the erosion resistant insert occurs in situ, this will be associated with a reduction in volume but this can be readily accommodated by providing a layer of compressible, refractory material, e.g. ceramic fibres adjacent the inner surface of the insert 8.

Figure 2:
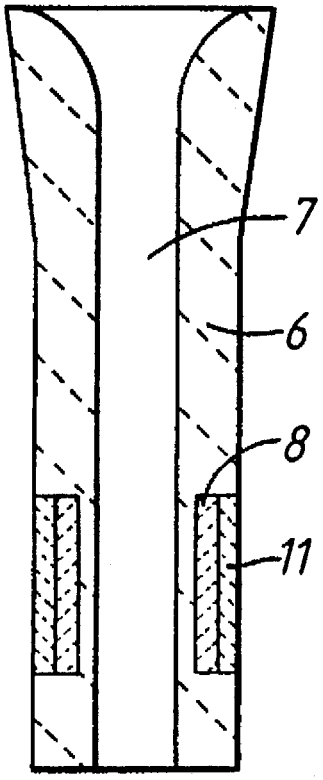
FIG. 2 is a similar view of an SEN in accordance with the present invention.

The service life of a nozzle as shown in FIG. 1*a* is sufficient to enable only one ladle of molten or even less to be poured before replacement is necessary due to slag line erosion. Nozzles as shown in FIGS. 1*b* and 1*c* have an increased service life sufficient to pour, typically, four ladles of molten steel. However, the nozzle in accordance with the invention as shown in FIG. 2 is found to have a significantly improved service life sufficient to pour, typically, ten ladles.

It will be appreciated that, as an alternative to alumina graphite, the nozzle body 6 may be made of any material suitable for the purpose, such as fused silica, and that the erosion resistant insert 8 may comprise materials other than zirconia, e.g. magnesia or even alumina with a lower graphite content than the nozzle body. The invention has been described principally in connection with nozzles for pouring steel but it is equally applicable to nozzles for pouring non-ferrous metals, such as aluminium, where similar nozzle erosion problems arise.

Obviously, numerous modifications and variations of the present invention are possible in the light of the above teachings. It is therefore to be understood that within the scope of the appended claims, the invention may be practiced otherwise than as specifically described herein.

I claim:

1. An immersed metallurgical pouring nozzle comprising a body of refractory material, said body defining a flow passage, and an annular member of refractory material, the erosion resistance of said annular member being higher than that of said body of said nozzle, said annular member being wholly encapsulated in said body of said nozzle, wherein an annular portion of said body of said nozzle is situated outside said annular member, said annular portion being made of a refractory material whose erosion resistance is greater than that of the remainder of said body of said nozzle but is less than that of said annular member and wherein the material of said body of said nozzle is co-pressed.

2. A nozzle as claimed in claim 1, wherein said annular member contains carbon in an amount of between 0 and 10% by weight.

3. A nozzle as claimed in claim 1, wherein the materials of said body of said nozzle and of said annular member are co-pressed.

4. A nozzle as claimed in claim 1, wherein the material of said annular member is sintered in situ.

* * * * *